US009316418B2

(12) United States Patent
Tajima

(10) Patent No.: US 9,316,418 B2
(45) Date of Patent: Apr. 19, 2016

(54) APPARATUS FOR ACHIEVING CRYOGENIC TEMPERATURE IN MOVABLE SYSTEM

(71) Applicant: INTER-UNIVERSITY RESEARCH INSTITUTE CORPORATION HIGH ENERGY ACCELERATOR RESEARCH ORGANIZATION, Tsukiba-shi, Ibaraki (JP)

(72) Inventor: Osamu Tajima, Ibaraki (JP)

(73) Assignee: INTER-UNIVERSITY RESEARCH INSTITUTE CORPORATION HIGH ENERGY ACCELERATOR RESEARCH ORGANIZATION, Tsukuba-shi (JP)

( * ) Notice: Subject to any disclaimer, the term of this patent is extended or adjusted under 35 U.S.C. 154(b) by 135 days.

(21) Appl. No.: 14/178,349

(22) Filed: Feb. 12, 2014

(65) Prior Publication Data

US 2014/0230456 A1 Aug. 21, 2014

(30) Foreign Application Priority Data

Feb. 15, 2013 (JP) ..... 2013-027675

(51) Int. Cl.

| | |
|---|---|
| ***F25B 9/00*** | (2006.01) |
| ***H01R 39/00*** | (2006.01) |
| ***F25B 9/14*** | (2006.01) |
| ***F25D 19/00*** | (2006.01) |
| *F25B 9/10* | (2006.01) |

(52) U.S. Cl.

CPC . *F25B 9/14* (2013.01); *F25D 19/00* (2013.01); *F25B 9/10* (2013.01)

(58) Field of Classification Search

CPC ..... F25B 9/00; F25B 9/06; F25B 9/14; F25B 2309/004; F25B 2309/006; F25B 2309/14181; F25B 9/145; F25B 9/002; F25B 9/08; F25B 2309/1421

USPC ..... 285/98; 439/13

See application file for complete search history.

(56) References Cited

U.S. PATENT DOCUMENTS

| | | | | |
|---|---|---|---|---|
| 5,207,069 | A * | 5/1993 | Matsuda | B01D 8/00 417/901 |
| 5,361,588 | A * | 11/1994 | Asami | F25B 9/14 60/520 |
| 2007/0251246 | A1* | 11/2007 | Maytal | F25B 9/02 62/6 |
| 2008/0245077 | A1* | 10/2008 | Xu | F16K 31/041 62/6 |

FOREIGN PATENT DOCUMENTS

JP 2009-74774 A 4/2009

OTHER PUBLICATIONS

S. Oguri, "Cryogenic cooling with cryocooler on a rotating system", pp. 1-5.*

* cited by examiner

*Primary Examiner* — Frantz Jules
*Assistant Examiner* — Erik Mendoza-Wilkenfel
(74) *Attorney, Agent, or Firm* — Westerman, Hattori, Daniels & Adrain, LLP

(57) ABSTRACT

An apparatus for achieving a cryogenic temperature in a movable system, includes a rotating table, a vacuum chamber which is fixed on the rotating table, a cryogen-free refrigerator which has a cooling section inside the vacuum chamber, an inner cylinder which is fixed to a bottom of the rotating table, an outer cylinder which stores the inner cylinder such that the inner cylinder is rotatable and includes an outward and return gas port which is provided to be continuous with gas passages, a compressor which circulates gas to the cryogen-free refrigerator through the outward and return gas passages, and a rotary joint for wiring which is fixed to the inner cylinder and rotatably conducts electricity, wherein a piece of internal wiring is led through a through-hole and a hole, and electricity is supplied to a piece of equipment on the rotating table through the piece of internal wiring.

9 Claims, 5 Drawing Sheets

High speed rotation scan eliminates the effects of 1/f noise, i.e. baseline fluctuation.

→ Enlargement of observing area

→ No efficiency loss induced by the 1/f noise filtering

APPARATUS FOR ACHIEVING CRYOGENIC TEMPERATURE IN MOVABLE SYSTEM

TECHNICAL FIELD

The present invention relates to a cooling apparatus which achieves arrival at a cryogenic temperature (of not more than several kelvins) and can maintain the cryogenic temperature for a long time in a system for movement (hereinafter referred to as a movable system), particularly a system for continuous rotation (hereinafter referred to as a continuous rotation system), a system for repetition of rotation and stoppage, and a system for temporary rotation.

BACKGROUND ART

A method which uses a liquid refrigerant, such as liquid helium, retained in a cooling section has been commonly used.

However, in a conventional method using a liquid refrigerant, a time period during which a cryogenic temperature is maintained is several days at most, and the ultimate temperature is only 4.2 kelvins, due to, e.g., vaporization and diffusion of the liquid refrigerant. Additionally, cooling from room temperature is impossible without stopping rotation. In addition, maintenance, such as addition of the liquid refrigerant, requires great effort and cost.

There is also known a cryogen-free refrigerator as in, e.g., Patent Literature 1. A cryogen-free refrigerator is a mechanical refrigerator without a liquid refrigerant, and examples thereof include a GM refrigerator. Although use of a cryogen-free refrigerator eliminates the need for maintenance, such as replenishment of a liquid refrigerant, the use is problematic in that a power source and a helium gas pipe are connected to the cryogen-free refrigerator to be rotated.

CITATION LIST

Patent Literature

[Patent Literature 1] Japanese Patent Laid-Open No. 2009-74774

SUMMARY OF INVENTION

Problem to be Solved by the Invention

It is an object of the present invention to provide an apparatus which allows running of a cryogen-free refrigerator using gas (hereinafter abbreviated as a cryogen-free refrigerator) and is capable of achieving a cryogenic temperature and maintaining the cryogenic temperature for a long time in a movable system, particularly a continuous rotation system, a system for repetition of rotation and stoppage, and a system for temporary rotation.

Means for Solving the Problem

In order to solve the above-described problems, the present invention is;

(1)

An apparatus for achieving a cryogenic temperature in a movable system, the apparatus being a cryogenic temperature cooling apparatus running a cryogen-free refrigerator in a continuous rotation system and capable of achieving the cryogenic temperature and maintaining the cryogenic temperature for a long time, characterized by comprising:

a rotating table which has a hole pierced in a rotation center portion in a vertical direction;

a frame which holds the rotating table such that the rotating table is rotatable;

a vacuum chamber which is fixed on the rotating table;

a cryogen-free refrigerator which has a cooling section inside the vacuum chamber;

a rotary joint for gas which is fixed at a bottom of the rotating table, includes a through-hole extending through the rotary joint in the vertical direction, and airtightly and rotatably feeds gas to the cryogen-free refrigerator;

a compressor which is installed on a non-rotating surface and circulates gas to the cryogen-free refrigerator through the rotary joint for gas; and a rotary joint for wiring which is fixed to the rotary joint for gas and rotatably conducts electricity onto the rotating table, wherein a piece of internal wiring which is connected to the rotary joint for wiring is led through the through-hole and the hole, and electricity is supplied to a piece of equipment on the rotating table through the piece of internal wiring.

(2)

The apparatus for achieving the cryogenic temperature in the movable system according to item (1), characterized in that the rotary joint for gas is composed of:

an inner cylinder which is fixed to the bottom of the rotating table and includes a through-hole extending through the inner cylinder in the vertical direction and an outward and return gas passage letting the gas pass through; and an outer cylinder which airtightly stores the inner cylinder such that the inner cylinder is rotatable and feeds the gas to the outward and return gas passage.

(3)

The apparatus for achieving the cryogenic temperature in the movable system according to item (2), characterized in that the inner cylinder includes an outward gas passage and a return gas passage which are open at a side wall and at an upper portion, and the outer cylinder includes a first annular groove at an inner periphery which is provided to be continuous with the outward gas passage and an outward gas port which is provided to be continuous with the first annular groove and is open at an outer periphery, and a second annular groove at the inner periphery which is provided to be continuous with the return gas passage and a return gas port which is provided to be continuous with the second annular groove and is open at the outer periphery.

(4)

The apparatus for achieving the cryogenic temperature in the movable system according to any one of items (1) to (3), characterized in that the rotary joint for wiring has a non-rotating connector section on one side connected to a piece of wiring from a power source and a rotating connector section at the other end connected to a piece of internal wiring which supplies electricity to the cryogen-free refrigerator.

(5)

The apparatus for achieving the cryogenic temperature in the movable system according to any one of items (1) to (4), characterized in that a monitor which outputs temperature and pressure data inside the vacuum chamber and temperature of an object to be cooled is placed on the rotating table.

(6)

The apparatus for achieving the cryogenic temperature in the movable system according to item (5), characterized in that a PC which controls running of various devices installed in the vacuum chamber and records data output to the monitor is placed on the rotating table.

(7)

The apparatus for achieving the cryogenic temperature in the movable system according to item (6), characterized in that a router for wireless LAN communication between the PC and a PC which is arranged on a non-rotating surface is placed on the rotating table.

(8)

The apparatus for achieving the cryogenic temperature in the movable system according to any one of items (1) to (7), wherein the rotating table is in a system which repeats rotation and stoppage.

(9)

The apparatus for achieving the cryogenic temperature in the movable system according to any one of items (1) to (7), wherein the rotating table is in a system for temporary rotation.

Advantageous Effects of Invention

The present invention with the above-described configuration exerts the advantageous effects below. That is, a rotary joint for gas which is composed of an inner cylinder and an outer cylinder is adopted, gas with high pressure and high purity is made to pass through the rotary joint for gas and is made to circulate between a cryogen-free refrigerator on a rotating table and a compressor installed on a non-rotating surface, and electricity, cables, or the like is connected via a rotary joint for wiring and is led through a through-hole of the rotary joint for gas. These contrivances allow running of the cryogen-free refrigerator on the rotating table. That is, the contrivances have achieved a cryogenic temperature in a system for continuous rotation and have allowed long-time maintenance of a cryogenic temperature state. It is, of course, possible to run the cryogen-free refrigerator (perform cooling) and raise temperature when rotation is not performed, when rotation and stoppage are repeated, and when rotation is temporarily performed.

Even when rotation is continued, a cryogenic temperature can be maintained over a long period. A device (an object to be cooled) which requires a cryogenic temperature can be used at a cryogenic temperature in a rotating state. An object to be cooled is arranged in the vacuum chamber. After a system is constructed, replenishment of a liquid refrigerant is not performed, and the system is almost maintenance-free.

The gas refers to a gas which is not liquefied at a cryogenic temperature. A cryogenic temperature in the present invention refers to a temperature of generally not more than 10 K, preferably not more than 4 K, more preferably not more than 1 K. As the gas, for example, helium-4 gas (helium gas with a mass number of 4) or helium-3 gas (helium gas with a mass number of 3) is preferable.

Examples of the object to be cooled include a condenser lens or a focal lens of a radio telescope, a sensor (generally referring to a part which detects electromagnetic waves caught by an antenna and converts the electromagnetic waves into an electric signal) of a meteorological observation instrument, and a receiver (generally referring to a part which reads an electric signal from a sensor and performs arithmetic processing on the electric signal).

In the present invention, there is, in principle, no limit to ultimate temperature, and a temperature of not more than 3 kelvins can be easily arrived at. Combination of refrigerators allows arrival at the vicinity of absolute zero that is less than 1 kelvin. For example, 0.3 kelvin can be easily arrived at by combining a cryogen-free refrigerator and a helium-3 sorption refrigerator.

By arranging a PC and a monitor on a rotating table, it is possible to obtain various data from pieces of equipment mounted on an apparatus for achieving a cryogenic temperature in a continuous rotation system and control running of the pieces of equipment via a rotary joint for wiring. Additionally, by installing a router for radio on the rotating table, it is possible to obtain various data and control running of the various pieces of equipment and the apparatus through wireless LAN communication.

The present invention can be applied to a radio astronomical observation field (e.g., cryogenic temperature cooling of a lens or a focal plane of a rotating radio telescope), which allows high-sensitivity radio wave observation on the ground. Additionally, utilization of the present invention in many fields requiring a cryogenic temperature, such as weather, environment, and security, is expected. The present invention can maintain a cryogenic temperature for a long time, is maintenance-free, and allows significant increase in sensitometry and dramatic reduction in measurement time. In addition, the present invention can be easily mounted on a flying object, such as an airplane, a satellite, or a space station. Utilization of the present invention in a medical instrument field, such as scanning surroundings of a human body by a device requiring a cryogenic temperature, is also expected. The present invention can run a cryogen-free refrigerator (perform cooling) and raise temperature both in a system for repetition of rotation and stoppage and in a system for temporary rotation. It is thus possible to mount an apparatus for achieving cryogenic temperature cooling in a movable system according to the present invention on, for example, the radio telescope or the meteorological observation instrument.

MODE FOR CARRYING OUT THE INVENTION

Embodiments of the present invention will be described in detail below with reference to the accompanying drawings. Note that the present invention is not limited to the embodiments below.

First Embodiment

Figure 1:
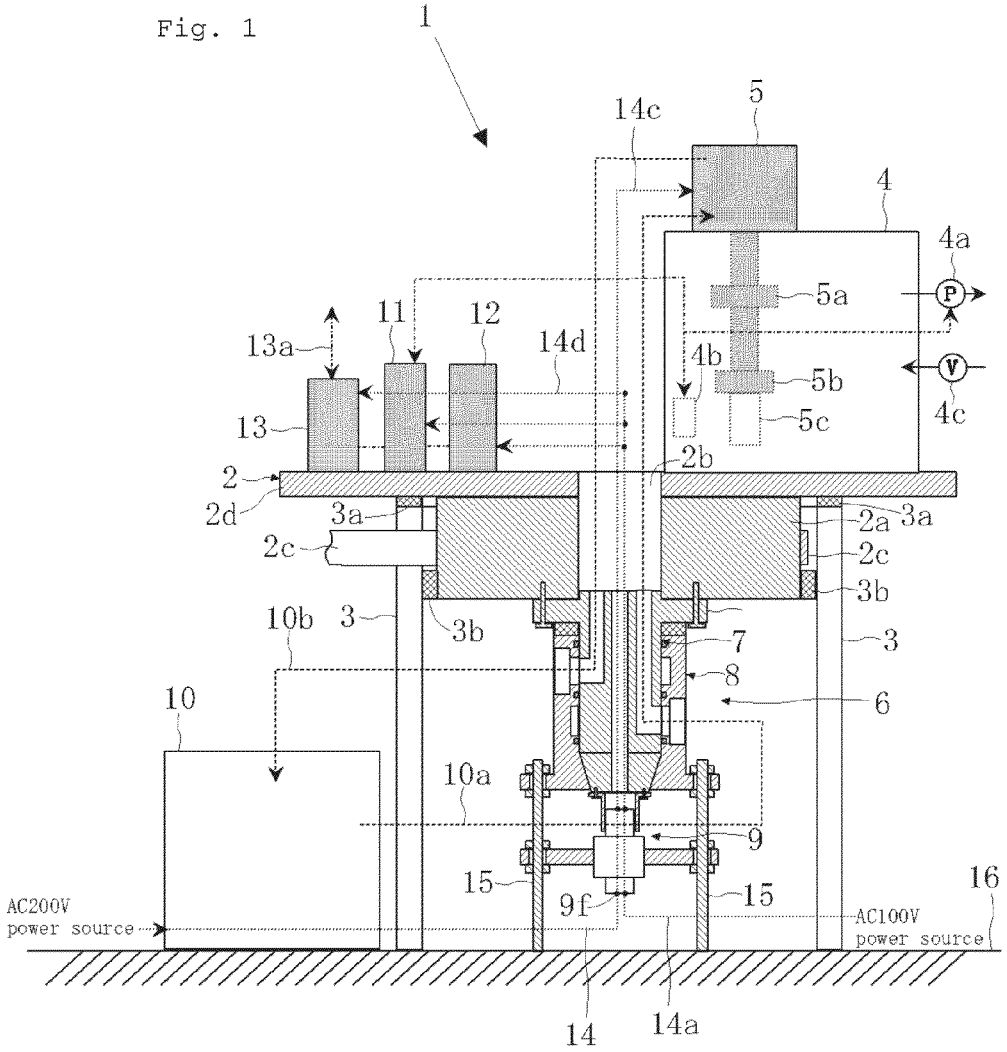
FIG. 1 is a conceptual view of a local section of an apparatus for achieving a cryogenic temperature in a movable system which is the present invention.
Figure 2:
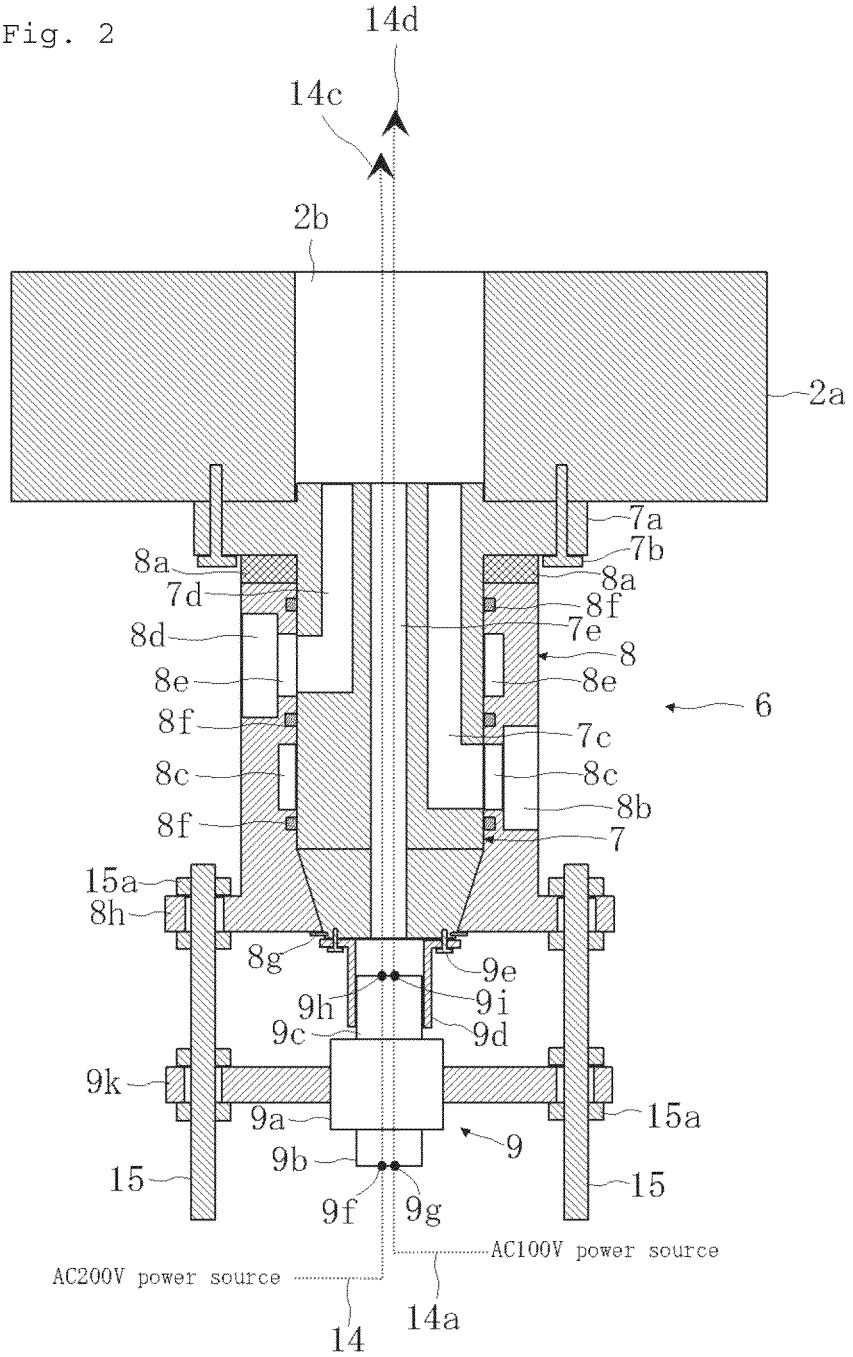
FIG. 2 is an enlarged local sectional view of a rotary joint for gas and a rotary joint for wiring.

As shown in the local sectional views of FIGS. 1 and 2, an apparatus 1 for achieving a cryogenic temperature using a cryogen-free method in a continuous rotation system which is an example of the present invention is an apparatus which runs a cryogen-free refrigerator in a system for continuous rotation and is capable of achieving a cryogenic temperature and maintaining the cryogenic temperature for a long time in a system for continuous rotation. The apparatus 1 is composed of a rotating table 2, a frame 3, a vacuum chamber 4, a cryogen-free refrigerator 5, a rotary joint 6 for gas which is made up of an inner cylinder 7 and an outer cylinder 8, a rotary joint 9 for wiring, pillars 15, a compressor 10, various pieces of equipment placed on the rotating table 2, an AC 200V power source which supplies electricity to the cryogen-free refrigerator 5, and an AC 100V power source which supplies electricity to the various pieces of equipment.

The rotating table 2 is composed of an upper surface 2*d* and a rotating shaft 2*a* which is fixed to a bottom of the upper surface 2*d*, and a hole 2*b* is pierced in a rotation center portion in a vertical direction. The vacuum chamber 4 and various pieces of equipment which are driven by electricity supplied from a non-rotating surface are placed on the upper surface 2*d*. The vacuum chamber 4 and various pieces of equipment are desirably arranged in consideration of the weight balance among them and their barycenters. The rotating table 2 is rotated by driving of a motor (not shown) that is transmitted through a belt 2*c* which is included in the rotating shaft 2*a*.

The frame 3 is provided to stand on the non-rotating surface, such as a ground 16, fixes a bearing 3*a* (a thrust ball bearing), which rotates the rotating table 2 in a horizontal direction under the load of the rotating table 2, between the frame 3 and the upper surface 2*d* of the rotating table 2 and fixes a bearing 3*b* (an angular ball bearing) which prevents an axial runout of the rotating shaft 2*a*, between the frame 3 and the rotating shaft 2*a*, and holds the rotating table 2 such that the rotating table 2 is rotatable.

The vacuum chamber 4 is fixed on the rotating table 2, and the pressure inside the vacuum chamber 4 is reduced by a pump 4*a* which rotates together with the rotating table 2. An object 5*c* to be cooled is arranged inside the vacuum chamber 4. Various devices 4*b*, such as an additional cooling device, are also arranged, as needed. Operation of the pump 4*a* for exhausting air from the vacuum chamber 4, a valve 4*c* for air intake provided in a path for introduction of gas into the vacuum chamber 4, the various devices 4*b*, and the like, all of which are shown in FIG. 1, is controlled by a PC 11 (to be described later). The various devices 4*b* provided inside the vacuum chamber 4 are, for example, a lens, a sensor, a receiver, and the like.

The cryogen-free refrigerator 5 is a mechanical refrigerator, such as a GM refrigerator, and does not use a liquid refrigerant. Activation and driving of a motor pump (not shown) of the cryogen-free refrigerator 5 are controlled by the compressor 10. The cryogen-free refrigerator 5 is driven by AC 200V power supplied from the compressor 10.

A cooling section (a 1st stage 5*a* and a 2nd stage 5*b*) is located inside the vacuum chamber 4. The object 5*c* to be cooled is provided to be in direct contact with or be indirectly continuous with the cooling section and is cooled to a cryogenic temperature. Inside the cryogen-free refrigerator 5, gas is circulated (as indicated by dashed arrows) by the compressor 10. Gas heading from the compressor 10 toward the cryogen-free refrigerator 5 is an outward gas 10*a*, and gas returning from the cryogen-free refrigerator 5 to the compressor 10 is a return gas 10*b*. The compressor 10 and the cryogen-free refrigerator 5 are connected by pipes and the rotary joint 6 for gas.

As shown in FIG. 2, in the inner cylinder 7, a flange 7*a* is fixed to a bottom (the rotating shaft 2*a*) of the rotating table 2 with a fastener 7*b*. The inner cylinder 7 includes, in its inside, a through-hole 7*e* which extends through the inner cylinder 7 in the vertical direction and an outward gas passage 7*c* and a return gas passage 7*d* which let gas pass through and are open at a side wall and an upper portion. Respective pipes which are linked to the cryogen-free refrigerator 5 and let gas pass through are connected to upper openings of the outward gas passage 7*c* and the return gas passage 7*d*. A distal end portion of the inner cylinder 7 is shaped so as not to come off from the outer cylinder 8 and is tapered downward here.

The outer cylinder 8 airtightly stores the inner cylinder 7 and includes, at an upper portion, a bearing 8*a* which holds the inner cylinder 7 such that the inner cylinder 7 is rotatable. High-pressure gas is sealed in by fitting O-rings 8*f* into grooves which are provided above or below gas passages (first and second annular grooves 8*c* and 8*e*) at an inner wall surface of the outer cylinder 8. O-rings are used or welding is performed to connect the flange 7*a* and the rotating shaft 2*a* and connect the rotating shaft 2*a* and the rotating table 2. With this configuration, the airtightness of the hole 2*b* is maintained.

The outer cylinder 8 includes, at an inner periphery, the first annular groove 8*c* that is provided to be continuous with the outward gas passage 7*c* and an outward gas port 8*b* which is provided to be continuous with the first annular groove 8*c* and is open at an outer periphery. The outer cylinder 8 includes, at a position different from that of the first annular groove 8*c* of the inner periphery, the second annular groove 8*e* that is provided to be continuous with the return gas passage 7*d* and a return gas port 8*d* which is provided to be continuous with the second annular groove 8*e* and is open at the outer periphery. Respective pipes which are linked to the compressor 10 and let gas pass through are connected to the outward and return gas ports 8*b* and 8*d*.

At a bottom of the inner cylinder 7, a snap ring 8*g* holds the inner cylinder 7 such that the inner cylinder 7 is rotatable with respect to the outer cylinder 8 and prevents the inner cylinder 7 from floating from the outer cylinder 8.

If the annular grooves formed in the outer cylinder are made inclined, the inner cylinder can be moved up and down, as needed.

In the rotary joint 9 for wiring, a holder 9*d* which is fixed to the inner cylinder 7 with a fastener 9*e* holds a rotating connector section 9*c* which has a plurality of protruding terminals and rotates together with the inner cylinder 7 and the holder 9*d*, and a non-rotating connector section 9*b* which has a plurality of protruding terminals at the other end of the rotary joint 9 for wiring is electrically connected to the rotating connector section 9*c* via a cover 9*a*. The cover 9*a* is filled with conductive liquid (mercury) and conducts electricity from a terminal of the non-rotating connector section 9*b* to a corresponding terminal of the rotating connector section 9*c*. The rotary joint 9 for wiring as described above is in the marketplace as a general electrical component. Examples of the rotary joint 9 for wiring include Model 830 available from Mercotac, Inc.

Here, a piece 14 of 200V wiring which is linked to the AC 200V power source is connected to one terminal of the non-rotating connector section 9*b* (at a contact 9*f*), and a piece 14*a* of 100V wiring which is linked to the AC 100V power source is connected to another terminal (at a contact 9*g*). At the other end, a piece 14*c* of internal wiring which supplies electricity to the cryogen-free refrigerator 5 is connected to a terminal of the rotating connector section 9*c* which is electrically linked to the contact 9*f* (at a contact 9*h*), and a piece 14*d* of internal wiring which supplies electricity to the various pieces of equipment on the rotating table 2 is connected to a terminal which is electrically linked to the contact 9*g* (at a contact 9*i*).

The pillars 15 stand upright from the ground 16, extend through a holding section 9*k*, which is fixed to the pillars 15 with nuts 15*a*, and position the rotary joint 9 for wiring via the holding section 9*k*. Additionally, the pillars 15 extend through a flange 8*h* of the outer cylinder 8, which is fixed to the pillars 15 with the nuts 15*a*, and position the outer cylinder 8.

The compressor 10 is installed on the non-rotating surface, transfers gas with high purity (not less than 99.999%) into the cryogen-free refrigerator 5 and circulates the gas at high pressure (up to 16 MPa in the case of helium-4 gas) through the outward gas passage 7*c* and the return gas passage 7*d*. A heavy object, such as the compressor 10, is placed on the non-rotating surface, such as the ground 16. As a result, the weight of objects mounted on the rotating table 2 can be reduced, and a compact maintenance-free system can be provided.

The various pieces of equipment put on the rotating table 2 include a personal computer (the PC 11), a monitor 12, a router 13, and the pump 4*a*.

The PC 11 is supplied with power from the piece 14*d* of internal wiring connected to the 100V power source and is driven. The PC 11 controls running of the monitor 12, the router 13, and the pump 4*a* and further controls operation of the various devices 4*b* put inside the vacuum chamber 4.

The monitor 12 outputs the temperature and pressure data inside the vacuum chamber 4 and the temperature value of the object 5*c* to be cooled. The monitor 12 is connected to the PC 11. The PC 11 may output the temperature and pressure data inside the vacuum chamber 4 that are acquired.

The router 13 is connected to the PC 11 to allow wireless LAN communication between the PC 11 and a PC which is not mounted in the apparatus 1 for achieving a cryogenic temperature in a continuous rotation system. The inclusion of the router 13 makes it possible to obtain various data inside the vacuum chamber 4, control the PC 11, and control the various devices 4*b* via the PC 11 from a separate location.

The apparatus 1 for achieving a cryogenic temperature in a continuous rotation system with the above-described configuration supplies electricity to the pieces of equipment on the rotating table 2 through the pieces 14*c* and 14*d* of internal wiring that are led through the through-hole 7*e* and the hole 2*b*. When the apparatus 1 is used after wiring installation and pipe installation, a target cryogenic temperature can be arrived at in a short time of about 1 to 2 hours, which depends on the performance of the refrigerator and the size of the chamber, only by switching on the compressor 10.

Figure 3:
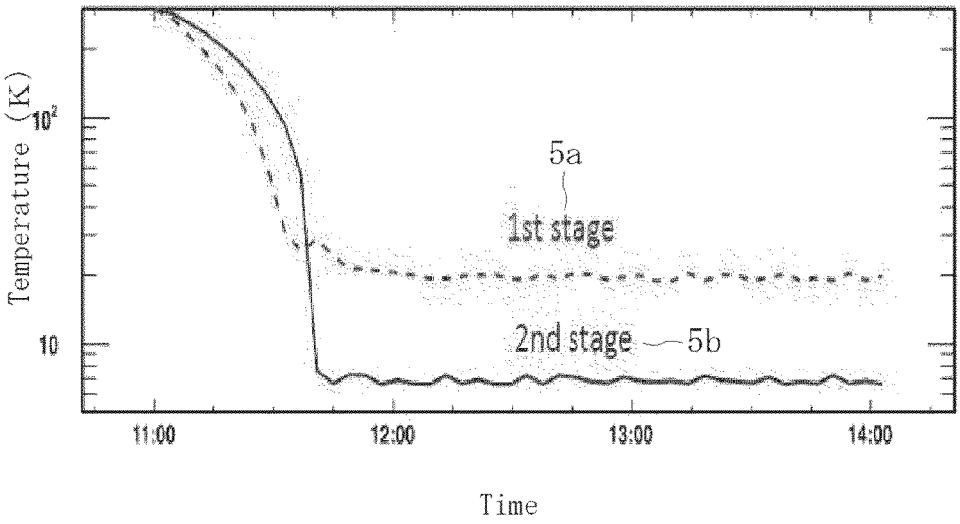
FIG. 3 is a result of a cryogenic temperature demonstration experiment according to the present invention.

In an actual experiment using helium-4 gas as gas, it was possible to arrive at a cryogenic temperature from room temperature in about 40 minutes, as shown in FIG. 3. The ordinate in FIG. 3 represents temperature (K (kelvin)) while the abscissa represents a measured time. A dashed line indicates a measured temperature value in the 1st stage 5*a* of the cryogen-free refrigerator 5, and a solid line indicates a measured temperature value in the 2nd stage 5*b*.

Second Embodiment

Figure 4:
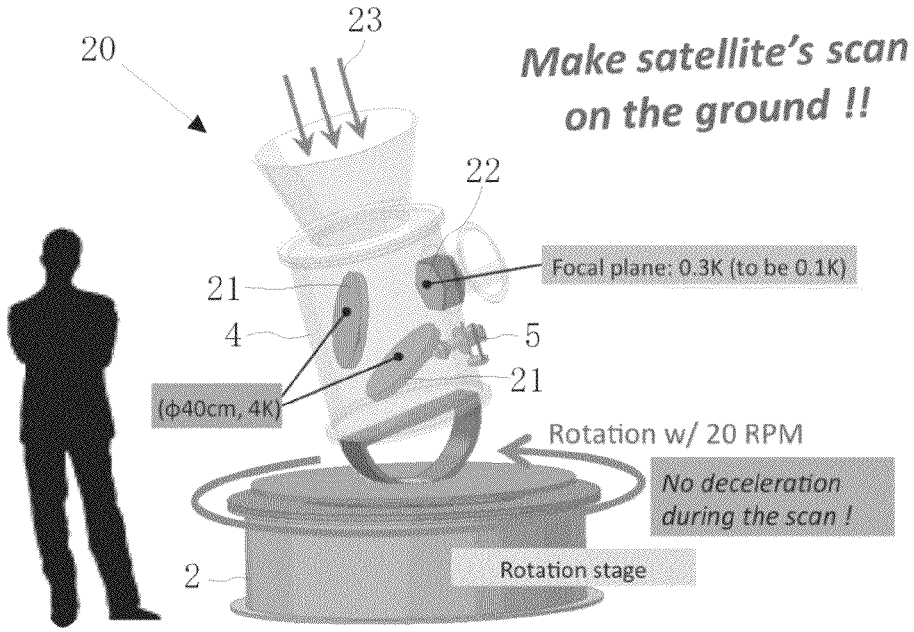
FIG. 4 is a schematic view showing an example of an apparatus for achieving a cryogenic temperature in a movable system which is the present invention.
Figure 5:
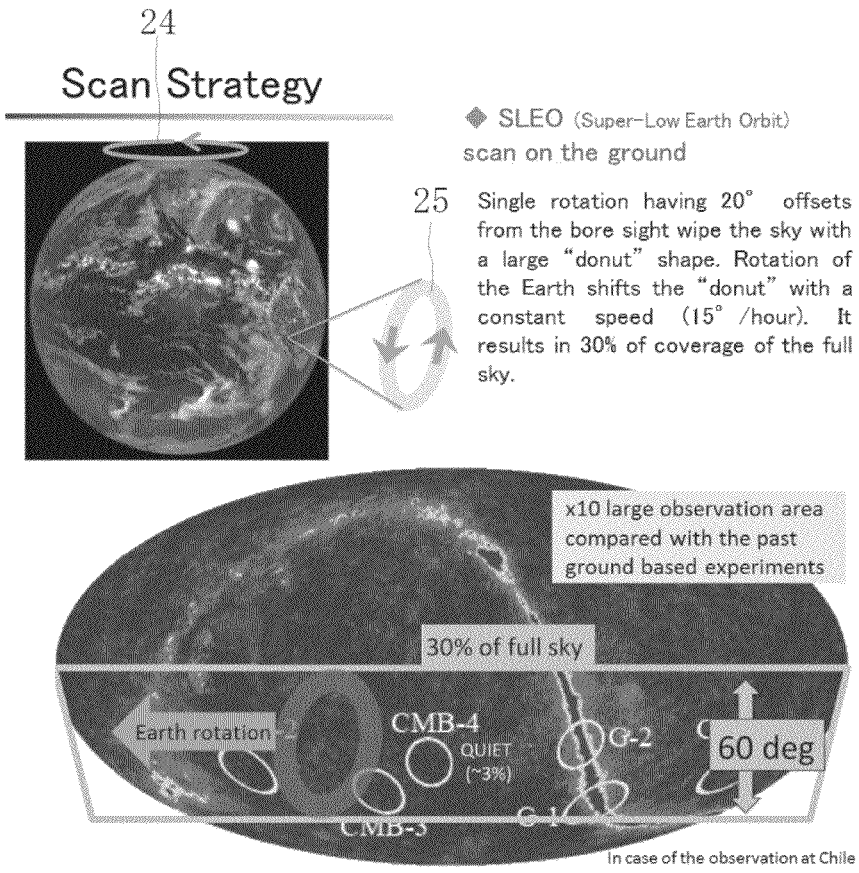
FIG. 5 is an explanatory view of an observation range of the apparatus for achieving a cryogenic temperature in a movable system.

The apparatus 1 for achieving a cryogenic temperature in a continuous rotation system which is configured in the above-described manner can be applied to an apparatus for achieving a cryogenic temperature in a movable system where a wide range of radio waves can be observed with high sensitivity on the ground, as shown in FIGS. 4 and 5. A rotating table 2 can be made to repeat rotation and stoppage or can be temporarily rotated.

An example of an apparatus 20 for achieving a cryogenic temperature in a movable system is shown in FIG. 4. Radio waves 23 enter a vacuum chamber 4 which is placed on the rotating table 2. Inside the vacuum chamber 4, lenses or sensors 21 as objects to be cooled and a focal plane or receiver 22 are arranged, and a cryogen-free refrigerator 5 cools the lenses or sensors 21 and the focal plane or receiver 22 to a cryogenic temperature. The sensitivity of each object to be cooled increases roughly in inverse proportion to the temperature of the focal plane or receiver 22. Thus, the apparatus 20 for achieving a cryogenic temperature in a movable system with the above-described configuration can rotate at high speed while maintaining high sensitivity. As a result, the apparatus 20 can perform wide-range observation alone, as shown in FIG. 5.

REFERENCE SIGNS LIST

1 apparatus for achieving a cryogenic temperature in a movable system
2 rotating table
2*a* rotating shaft
2*b* hole
2*c* belt
2*d* upper surface
3 frame
3*a* bearing
3*b* bearing
4 vacuum chamber
4*a* pump
4*b* various devices
4*c* valve
5 cryogen-free refrigerator
5*a* 1st stage
5*b* 2nd stage
5*c* object to be cooled
6 rotary joint for gas
7 inner cylinder
7*a* flange
7*b* fastener
7*c* outward gas passage
7*d* return gas passage
7*e* through-hole
8 outer cylinder
8*a* bearing
8*b* outward gas port
8*c* first annular groove
8*d* return gas port
8*e* second annular groove
8*f* O-ring
8*g* snap ring
8*h* flange
9 rotary joint for wiring
9*a* cover
9*b* non-rotating connector section
9*c* rotating connector section
9*d* holder
9*e* fastener
9*f* contact
9*g* contact
9*h* contact
9*i* contact
9*k* holding section
10 compressor
10*a* outward gas
10*b* return gas
11 PC
12 monitor
13 router
13*a* radio
14 piece of 200V wiring
14*a* piece of 100V wiring
14*c* piece of internal wiring

14*d* piece of internal wiring
15 pillar
15*a* nut
16 ground
20 apparatus for achieving a cryogenic temperature in a movable system
21 lens or sensor
22 focal plane or receiver
23 radio waves
24 rotation
25 scan area

The invention claimed is:

1. An apparatus for achieving a cryogenic temperature in a movable system, the apparatus being a cryogenic temperature cooling apparatus running a mechanical refrigerator without a liquid refrigerant in a continuous rotation system and capable of achieving the cryogenic temperature and maintaining the cryogenic temperature, comprising:

a rotating table which has a hole pierced in a rotation center portion in a vertical direction;

a frame which holds the rotating table such that the rotating table is rotatable;

a vacuum chamber which is fixed on the rotating table;

a mechanical refrigerator without a liquid refrigerant which has a cooling section inside the vacuum chamber;

a rotary joint for gas which is fixed at a bottom of the rotating table, includes a through-hole extending through the rotary joint in the vertical direction, and airtightly and rotatably feeds gas to the mechanical refrigerator without the liquid refrigerant;

a compressor which is installed on a non-rotating surface and circulates gas to the mechanical refrigerator without the liquid refrigerant through the rotary joint for gas; and a rotary joint for wiring which is fixed to the rotary joint for gas and rotatably conducts electricity onto the rotating table, wherein a piece of internal wiring which is connected to the rotary joint for wiring is led through the through-hole and the hole, and electricity is supplied to a piece of equipment on the rotating table through the piece of internal wiring.

2. The apparatus for achieving the cryogenic temperature in the movable system according to claim 1, wherein the rotary joint for gas comprises:

an inner cylinder which is fixed to the bottom of the rotating table and includes a through-hole extending through the inner cylinder in the vertical direction and an outward and return gas passage letting the gas pass through; and an outer cylinder which airtightly stores the inner cylinder such that the inner cylinder is rotatable and feeds the gas to the outward and return gas passage.

3. The apparatus for achieving the cryogenic temperature in the movable system according to claim 2, wherein the inner cylinder comprises an outward gas passage and a return gas passage which are open at a side wall and at an upper portion, and wherein the outer cylinder comprises a first annular groove at an inner periphery which is provided to be continuous with the outward gas passage and an outward gas port which is provided to be continuous with the first annular groove and is open at an outer periphery, and a second annular groove at the inner periphery which is provided to be continuous with the return gas passage and a return gas port which is provided to be continuous with the second annular groove and is open at the outer periphery.

4. The apparatus for achieving the cryogenic temperature in the movable system according to claim 1, wherein the rotary joint for wiring comprises a non-rotating connector section on one side connected to a piece of wiring from a power source and a rotating connector section at the other end connected to a piece of internal wiring which supplies electricity to the mechanical refrigerator without the liquid refrigerant.

5. The apparatus for achieving the cryogenic temperature in the movable system according to claim 1, wherein a monitor which outputs temperature and pressure data inside the vacuum chamber and temperature of an object to be cooled is placed on the rotating table.

6. The apparatus for achieving the cryogenic temperature in the movable system according to claim 5, wherein a PC which controls running of various devices installed in the vacuum chamber and records data output to the monitor is placed on the rotating table.

7. The apparatus for achieving the cryogenic temperature in the movable system according to claim 6, wherein a router for wireless LAN communication between the PC and a PC which is arranged on a non-rotating surface is placed on the rotating table.

8. The apparatus for achieving the cryogenic temperature in the movable system according to claim 1, wherein the rotating table is in a system which repeats rotation and stoppage.

9. The apparatus for achieving the cryogenic temperature in the movable system according to claim 1, wherein the rotating table is in a system for temporary rotation.

* * * * *